United States Patent [19]

Nash

[11] Patent Number: 4,573,205

[45] Date of Patent: Feb. 25, 1986

[54] TECHNIQUE FOR SECURE COMMUNICATIONS ON FM RADIO CHANNELS

[75] Inventor: Randy D. Nash, Ocean, N.J.

[73] Assignee: AT&T Bell Laboratories, Murray Hill, N.J.

[21] Appl. No.: 525,279

[22] Filed: Aug. 22, 1983

[51] Int. Cl.[4] ..... H04K 1/02

[52] U.S. Cl. ..... 455/30; 455/42; 179/1.5 M; 375/2.2

[58] Field of Search ..... 455/30, 42; 179/1.5 M; 375/2.2

[56] References Cited

U.S. PATENT DOCUMENTS

| | | | |
|---|---|---|---|
| 2,758,202 | 8/1956 | Wilmotte | 455/42 |
| 3,133,991 | 5/1964 | Guanella | 179/1.5 |
| 3,638,121 | 1/1972 | Spilker, Jr. | 455/30 |
| 3,651,268 | 3/1972 | Rivkin | 179/1.5 M |
| 3,723,878 | 3/1973 | Miller | 455/30 |
| 4,126,761 | 11/1978 | Graupe et al. | 179/1.5 R |
| 4,179,658 | 12/1979 | Bitzer | 455/30 |
| 4,361,729 | 11/1982 | Barnes, Jr. et al. | 179/1.5 R |

OTHER PUBLICATIONS

Proc. of the IEEE, vol. 52, #4, 4/64, "Frequency or Phase Modulation with a Noise Carrier" by Harrison E. Rowe.

1979 Carnahan Conference on Crime Countermeasures, University of Kentucky, Lexington, Kentucky, May 16–18, 1979, "Achieving and Measuring High Security in Analog Speech Communications Security Devices" by Arnold M. McCalmont, pp. 89–93.

*Primary Examiner*—Salvatore Cangialosi
*Assistant Examiner*—Aaron J. Lewis
*Attorney, Agent, or Firm*—Erwin W. Pfeifle

[57] ABSTRACT

This present invention relates to a system for providing secure communications without bandwidth expansion using an encryption method called masking whereby a masking signal is generated at the transmitter using a secret key which includes a predetermined threshold signal-to-noise ratio level that when added to a frequency modulated (FM) signal produces an unintelligible signal. Any type of masking signal as, for example, a sine wave, an FM signal, or bandlimited Gaussian noise, may be used. At the receiver, the corresponding masking signal used by the transmitter is regenerated and subtracted from the FM signal before demodulation. Because of the FM threshold effect, perfect removal of the masking signal is not required. It is only necessary to subtract enough of the masking signal such that the resulting signal-to-noise ratio (SNR) is above the required threshold for reliable demodulation of the original signal.

19 Claims, 2 Drawing Figures

TECHNIQUE FOR SECURE COMMUNICATIONS ON FM RADIO CHANNELS

BACKGROUND OF THE INVENTION

1. Field of the Invention

The present invention relates to a technique for secure communications on FM radio channels and, more particularly, to a technique which superimposes on an FM signal a masking signal of the same bandwidth.

2. Description of the Prior Art

Mobile radio and cordless telephone are among the communication services which have stimulated a demand for secure radio communications. To provide the degree of security required for these services digital ciphers can be built, as disclosed in, for example, U.S. Pat. No. 4,126,761 issued to D. Graupe et al. on Nov. 21, 1978 where the analog signal is converted to a digital signal and then encoded and converted back to an analog signal for transmission. However, a digitized analog signal requires more bandwidth for expansion than the same nondigitized analog signal. Some secret communications systems use bandwidth expansion means to mask signals as disclosed in, for example, U.S. Pat. Nos. 3,638,121 issued to J. J. Spilker, Jr. on Jan. 25, 1972 and 4,179,658 issued to D. R. Bitzer on Dec. 18, 1979. For frequency modulated (FM) radio services, frequency bandwidth is at a premium.

A means for masking an analog signal by the linear addition of a noiselike waveform generated from the original signal is disclosed in U.S. Pat. No. 4,361,729 issued to L. A. Barnes, Jr. et al. on Nov. 30, 1982.

The problem, therefore, remaining in the prior art is to provide secure communications for analog signals and in particular FM signals without bandwidth expansion.

SUMMARY OF THE INVENTION

The foregoing problem has been solved in accordance with the present invention which relates to a technique for secure communications on FM radio channels and, more particularly, to a technique which superimposes on an FM signal a masking signal of the same bandwidth.

It is an aspect of the present invention for providing a transmitter comprising a modulator capable of converting an input analog signal to a frequency modulated (FM) output signal at a nominal carrier frequency; means for generating an output masking signal which is limited to the band of the FM output signal and includes a predetermined threshold level such that when said masking signal is added to the FM output signal a resultant signal is generated which is unintelligible when received with a conventional FM receiver; and means for adding the output signals from the modulator and the output masking signal generating means for generating a transmitter output signal.

It is a further aspect of the present invention for providing secure communications without bandwidth expansion using an encryption method called masking. More particularly, a masking signal is generated from a secret key which includes a predetermined threshold level that when added to a frequency modulated signal produces an unintelligible signal. Any type of masking signal as, for example, a sine wave, an FM signal, or bandlimited Gaussian noise, may be used. At the receiver, the masking signal is regenerated and subtracted from the FM signal before demodulation. Because of the FM threshold effect, perfect removal of the masking signal is not required. It is only necessary to subtract enough of the masking signal such that the resulting signal-to-noise ratio (SNR) is above the required threshold for reliable demodulation.

Other and further aspects of the present invention will become apparent during the course of the following description and by reference to the accompanying drawings.

BRIEF DESCRIPTION OF THE DRAWINGS

Referring now to the drawings.

DESCRIPTION OF THE PREFERRED EMBODIMENT

Figure 1:
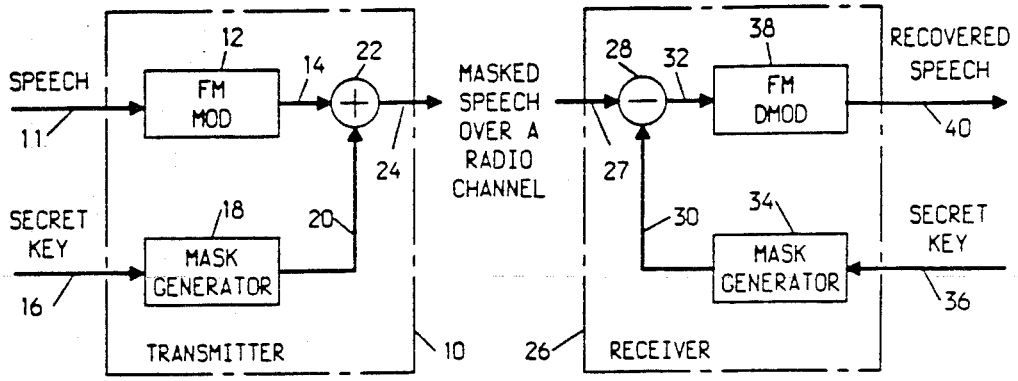
FIG. 1 is a block diagram of the secure communications system in accordance with the present invention.

Referring now to FIG. 1 wherein is shown a block diagram of the secure communications system according to the invention, at a transmitter 10, an input analog signal on lead 11 is applied to an FM modulator 12 which generates an output FM signal on lead 14 with a predetermined bandwidth. A secret key is applied via lead 16 to a mask generator 18, which in response thereto, generates an output masking signal on lead 20 with essentially the same bandwidth as the FM signal on lead 14 and at a predetermined level. The FM signal on lead 14 and the masking signal on lead 20 are applied as separate inputs to a linear adder 22 which superimposes the masking signal on the FM signal and generates as an ouput on lead 24 a masked analog signal which is unintelligible for transmission over a radio channel.

At a receiver 26, a secret key on lead 36 is applied to a mask generator 34 which generates an output masking signal on lead 30 corresponding to the masking signal generated by mask generator 18 so that the output masking signal on lead 30 and the arriving masking signal on lead 27 are coherent. The transmitted masked FM signal on lead 27 and the output masking signal on lead 30 are applied as separate inputs to a linear subtractor 28 generating an FM signal on lead 32 with the masking signal essentially eliminated. The output signal from linear subtractor 28 is applied to an FM demodulator 38 for generating a recovered analog signal on lead 40.

Figure 2:
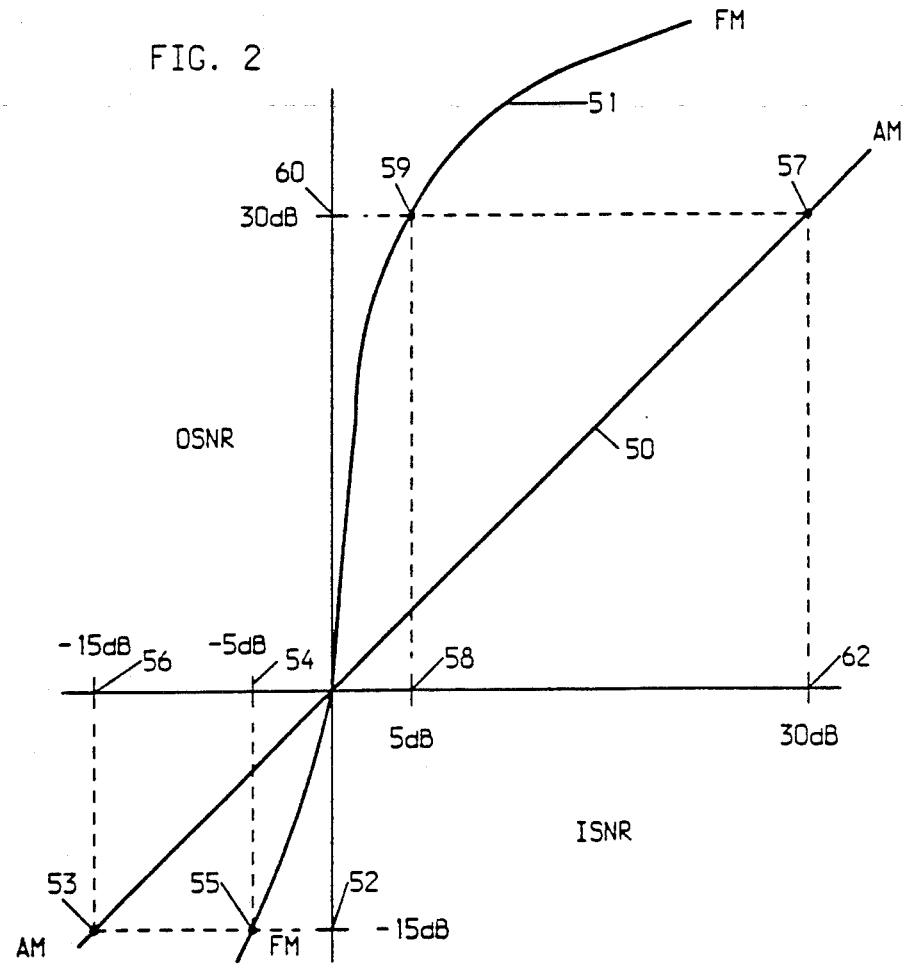
FIG. 2 is a graphic diagram of the threshold effect used in the arrangement of FIG. 1.

Masking is not generally effective for secure communications over radio channels. To effectively mask an analog signal, for example, speech with a masking signal as, for example, Gaussian noise, without FM modulation and using AM modulation techniques, the masking signal should be 15–20 db greater than the analog signal. However, in accordance with the present invention, masking is effective for radio communications if the input analog signal is masked after it is FM modulated in accordance with the present invention as shown in FIG. 1. The advantages obtained with the present arrangement of FIG. 1 over prior art pre-modulation techniques can be seen with reference to FIG. 2. In FIG. 2 the input SNR and output SNR relationships are shown for AM and FM modulation by curves 50 and 51, respectively. From FIG. 2 it can be seen that wideband FM has an interesting "threshold" effect, which effect is well-known in the art as shown, for example, in the book "Information Transmission, Modulation, and Noise" by Mischa Schwartz as published by McGraw-Hill Book Company on pp. 406–408.

From FIG. 2 it can be seen that if a −15 db mask level is needed to provide an unintelligible masked output signal, as shown at point 52, if the AM masking technique were used then an input mask level of −15 db would have to be applied, as shown by point 56. However, by using the present FM modulation technique, the output masked signal can be made unintelligible by the use of a mask using only an at least −Xdb level, as shown by point 54, which level is considerably lower than the −15 db level for the AM modulation technique. For purposes of discussion hereinafter, the at least −Xdb level will be considered to be at least −5 db.

Without FM modulation to recover the input analog signal with, for example, a 30 db output SNR, as shown by point 60, a radio channel with a SNR of 45–50 db is required. This type of channel is generally not available. With FM modulation to recover the input analog signal at the same output SNR, as shown by point 60, the sum of the masking signal and the channel noise must be greater than or equal to a Y db level, as shown by point 58, which is less then required for AM modulation techniques. For purposes of discussion hereinafter, the Y db level will be considered to be +5 db. Therefore, a channel with a SNR of approximately 30 db could be used. This type of channel is more readily available.

For a clearer understanding of the advantages obtained by the present arrangement, if a receiver only included an AM demodulator instead of present components 38, 28, and 34, then the signal arriving on lead 27 would be unintelligible because such demodulator would get a signal at −15 db SNR. If the receiver only included an FM demodulator then the signal would be unintelligible because such demodulator would get a signal at −5 db SNR. If a receiver included components 28, 34, and 38 but generated a different mask than was generated by mask generator 18 at the transmitter, then the incorrect masking signal merely adds additional noise to the signal arriving on lead 27 and recovery of the FM signal is not possible.

If the receiver includes components 28, 34, and 38 and generates the same mask as generated by mask generator 18 at the transmitter, then if the mask signal was removed perfectly by subtractor 28, only channel noise would be left, e.g., the exemplary −30 db which is shown on the curve of FIG. 2 as point 60 to provide a +5 db SNR shown by point 58. To recover the FM signal, the input signal to FM demodulator 38 should be above the +5 db point 58 in FIG. 2. It should be apparent that if the mask is not perfectly removed the recovered FM signal will be proportionately degraded.

It is to be understood that the above described embodiments are simply illustrative of the principles of the invention. Various other modifications and changes may be made by those skilled in the art which will embody the principles of the invention and fall within the spirit and scope thereof. For example, any type of signal as, for example, a sine wave, a second FM signal, or bandlimited Gaussian noise, may be used for the masking signal.

What is claimed for:

1. A transmitter for providing secure communications comprising:

a modulator capable of converting an input analog signal to a frequency modulated (FM) output signal at a nominal carrier frequency;

means for generating an output masking signal which is limited to the band of the FM output signal and includes a predetermined threshold level such that when said masking signal is added to the FM output signal a resultant signal is generated which is unintelligible when received with a conventional FM receiver; and means for directly adding the output signals from both the modulator and the output masking signal generating means for generating a transmitter output signal.

2. A transmitter according to claim 1 wherein the output signal from the generating means comprises at least a −5 db signal-to-noise ratio.

3. A transmitter according to claim 1 wherein the output masking signal comprises bandlimited Gaussian noise.

4. A transmitter according to claim 1 wherein the output masking signal comprises a separate FM signal.

5. A transmitter according to claim 1 wherein the output masking signal comprises a sine wave.

6. A receiver for providing secure communications capable of receiving from a remote transmitter an input signal including a masking signal superimposed on a frequency modulated (FM) signal with a predetermined signal-to-noise ratio such that the FM signal is unintelligible, the receiver comprising:

means for generating an output masking signal which corresponds to, and is synchronized with, the masking signal forming part of the input signal to the receiver;

means for directly subtracting the output masking signal generated by the generating means from the input signal to the receiver and generating a resultant output signal; and means for demodulating the resultant output signal from the subtracting means for recovering an original input analog signal used to generate the FM signal.

7. A receiver according to claim 6 wherein the output masking signal comprises bandlimited Gaussian noise.

8. A receiver according to claim 6 wherein the output masking signal comprises a separate FM signal.

9. A receiver according to claim 6 wherein the output masking signal comprises a sine wave.

10. A receiver according to claim 6 wherein the predetermined signal-to-noise ratio of the masking signal forming part of the input signal is at least −5 db.

11. A method of providing secure communications comprising the steps of:

at a transmitter, (a) converting an input analog signal to a frequency modulated (FM) output signal at nominal carrier frequency;

(b) generating an output masking signal which is limited to the band of the FM output signal and includes a predetermined threshold level such that when said masking signal is added to the FM output signal a resultant signal is generated which is unintelligible when received with a conventional FM receiver; and (c) directly adding the FM output signal from step (a) and the output masking signal from step (b) for generating a transmitter output signal.

12. A method of secure communications according to claim 11 comprising the further steps of:

at a receiver, (d) generating an output masking signal which corresponds to, and is synchronized with, the masking signal forming part of the transmitter output signal;

(e) subtracting the output masking signal from step (d) from the transmitter output signal received at the receiver for generating a resultant output signal;

(f) demodulating the resultant output signal from step (e) to generate the original input analog signal to the transmitter.

13. A method of providing secure communications according to claim 11 wherein in performing step (b) the output masking signal comprises at least a −5 db signal-to-noise ratio.

14. A method of providing secure communications according to claim 11 wherein in performing step (b) the output masking signal comprises bandlimited Gaussian noise.

15. A method of providing secure communications according to claim 11 wherein in performing step (b) the output masking signal comprises a separate FM signal.

16. A method of providing secure communications according to claim 11 wherein in performing step (b) the output masking signal comprises a sine wave.

17. A method of providing secure communications according to claim 12 wherein in performing step (d) the output masking signal comprises bandlimited Gaussian noise.

18. A method of providing secure communications according to claim 12 wherein in performing step (d) the output masking signal comprises a separate FM signal.

19. A method of providing secure communications according to claim 12 wherein in performing step (d) the output masking signal comprises a sine wave.

* * * * *